US006711271B2

(12) United States Patent
Hou

(10) Patent No.: US 6,711,271 B2
(45) Date of Patent: Mar. 23, 2004

(54) POWER MANAGEMENT FOR HEARING AID DEVICE

(75) Inventor: Zezhang Hou, Cupertino, CA (US)

(73) Assignee: Apherma Corporation, Sunnyvale, CA (US)

( * ) Notice: Subject to any disclaimer, the term of this patent is extended or adjusted under 35 U.S.C. 154(b) by 182 days.

(21) Appl. No.: 09/898,797

(22) Filed: Jul. 3, 2001

(65) Prior Publication Data

US 2002/0048382 A1 Apr. 25, 2002

Related U.S. Application Data

(60) Provisional application No. 60/216,504, filed on Jul. 3, 2000.

(51) Int. Cl.[7] ..... H04R 25/00

(52) U.S. Cl. ..... 381/323; 381/312; 455/574

(58) Field of Search ..... 381/312, 323; 455/574, 568, 569, 343, 570

(56) References Cited

U.S. PATENT DOCUMENTS

| | | | | |
|---|---|---|---|---|
| 4,592,087 A | | 5/1986 | Killion | |
| 5,706,351 A | * | 1/1998 | Weinfurtner | 381/314 |
| 5,938,691 A | * | 8/1999 | Schulman et al. | 607/57 |
| 6,026,288 A | * | 2/2000 | Bronner | 455/343 |
| 6,330,339 B1 | * | 12/2001 | Ishige et al. | 381/312 |

* cited by examiner

*Primary Examiner*—Curtis Kuntz
*Assistant Examiner*—Tuân Duc Nguyen
(74) *Attorney, Agent, or Firm*—Beyer Weaver & Thomas, LLP

(57) ABSTRACT

Improved approaches to reducing power consumption in hearing aids are disclosed. According to one aspect, hearing aids (namely, one or more components thereof) are able to be operated in different operational modes—at least one of which is a power saving mode. According to another aspect, intelligent switching between the operational modes is performed to reduce power consumption when appropriate.

14 Claims, 10 Drawing Sheets

POWER MANAGEMENT FOR HEARING AID DEVICE

CROSS-REFERENCE TO RELATED APPLICATIONS

This application claims the benefit of U.S. Provisional Application No. 60/216,504, filed Jul. 3, 2000, and entitled "POWER MANAGEMENT METHOD IN HEARING AIDS," the contents of which is hereby incorporated by reference.

BACKGROUND OF THE INVENTION

1. Field of the Invention

The present invention relates to hearing aid devices and, more particularly, to power management for hearing aid devices.

2. Description of the Related Art

Hearing aids amplify sounds for hearing impaired users. Hearing aids are small scale portable electronic devices that operate under battery power. Consequently, battery life is an important criteria for hearing aids.

Hearing aids have three major components that consume power: microphone(s), electronic integrated circuit (IC), and receiver. Typical hearing aid microphones drain about 20 $\mu$A current or higher when having a built-in amplifier. The most popular receiver is class-D amplifier receiver (see, e.g., U.S. Pat. No. 4,592,087), which drains about 100 to 300 $\mu$A, depending on brand and power output. Hearing aid manufactures typically buy microphones and receivers from companies who are more specialized in designing and manufacturing acoustical-electrical transducers. As a result, hearing aid manufactures normally cannot control power consumption of the microphones and receivers. However hearing aid manufacturers are able to reduce the power consumption of the electronic integrated circuit (IC), which varies greatly among the manufacturers.

Conventionally, power consumption of the electronic integrated circuit has been achieved through designing the circuitry with architectures that consume less power, using the most advanced IC process technology (e.g., 0.13 microns currently), and/or simplifying sound processing algorithms. One example of the simplifying is to use a lower precision in the sound processing algorithm which estimates sound energy.

Unfortunately, even with these conventional power saving design choices, hearing aids still consume significant amounts of power and thus do not enjoy prolonged battery life. Thus, there is a need for improved approaches to reduce power consumption in hearing aids.

SUMMARY OF THE INVENTION

Broadly speaking, the invention relates to improved approaches to reducing power consumption in hearing aids. According to one aspect of the invention, hearing aids (namely, one or more components thereof) are able to be operated in different operational modes—at least one of which is a power saving mode. According to another aspect of the invention, intelligent switching between the operational modes is performed to reduce power consumption when appropriate.

The invention can be implemented in numerous ways including as a method, system, apparatus, device, and computer readable medium. Several embodiments of the invention are discussed below.

As a method for managing power consumption of a hearing aid device, one embodiment of the invention includes at least the acts of: obtaining a sound identification for a sound signal picked-up by the hearing aid device; determining whether sound to be processed is present based on the sound identification for the sound signal; and placing the hearing aid device in a reduced power mode when the said determining determines that no significant sound to be processed is present.

As a method for managing power consumption of a hearing aid device, another embodiment of the invention includes at least the acts of: monitoring at least one signal characteristic for a sound signal picked-up by the hearing aid device; and switching between a normal power mode and a reduced power mode for the hearing aid device in accordance with the at least one signal characteristic for the sound signal.

As a hearing aid device, one embodiment of the invention includes at least: a microphone for picking up a sound signal, signal processing circuitry operatively connected to said microphone, a mode control circuit operatively connected to said signal processing circuitry, and an output device. The signal processing circuitry operates to process the sound signal to produce a modified sound signal. The signal processing circuitry also operates in a normal mode or a reduced power mode. The mode control circuit controls whether the signal processing circuitry operates in the normal mode or the reduced power mode. The output device produces an output sound in accordance with the modified sound signal.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention relates to improved approaches to reducing power consumption in hearing aids. According to one aspect of the invention, hearing aids (namely, one or more components thereof are able to be operated in different operational modes—at least one of which is a power saving mode. According to another aspect of the invention, intelligent switching between the operational modes of a hearing aid is performed to reduce power consumption when appropriate. The invention thus enables a hearing aid to yield not only high quality sound output but also extended battery life.

Embodiments of the invention are discussed below with reference to FIGS. 1–10. However, those skilled in the art will readily appreciate that the detailed description given herein with respect to these figures is for explanatory purposes as the invention extends beyond these limited embodiments.

Figure 1:
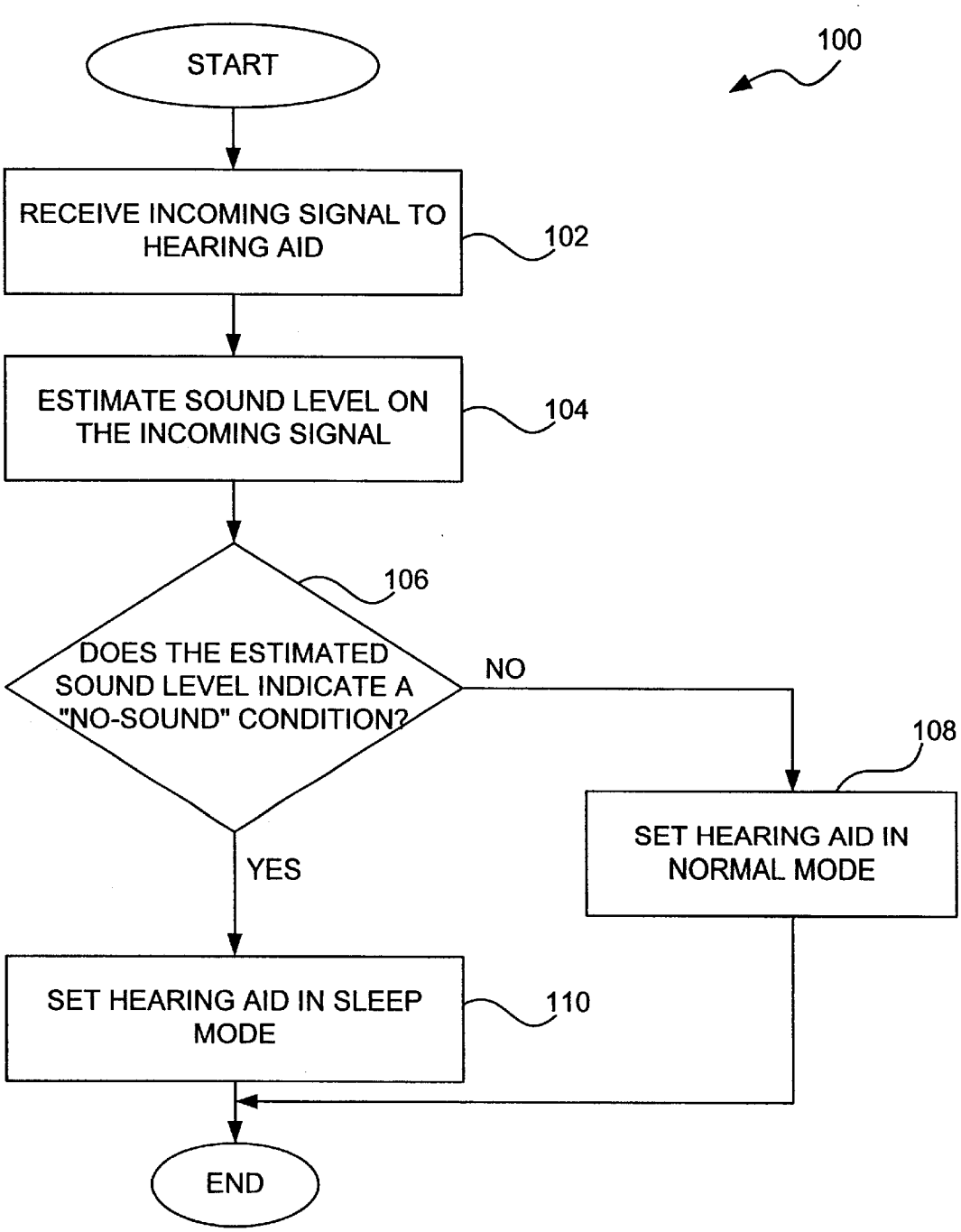
FIG. 1 is a flow diagram of power management processing according to one embodiment of the invention.

FIG. 1 is a flow diagram of power management processing 100 according to one embodiment of the invention. The power management processing 100 operates to reduce power consumption for a hearing aid device. The reduction in power consumption is achieved by switching the hearing aid between a normal processing mode and a sleep mode. The sleep mode can also be referred to as a standby mode or reduced power mode. By placing the hearing aid device in the sleep mode at appropriate times, the power management processing 100 is able to significantly prolong battery life for the hearing aid device.

The hearing aid device can generally be represented by three major components which consume power. Those components are a microphone, electronic circuitry (e.g., integrated circuit) and a receiver. The power management processing 100 operates to manage power consumption by the electronic circuitry of the hearing aid device. Since the electronic circuitry component is the typically the most "power hungry" component of a hearing aid device, the ability to manage its power consumption is most beneficial.

The power management processing 100 receives 102 an incoming signal to the hearing aid device. The incoming signal is representative of the sound picked up by the microphone of the hearing aid device. Typically, the incoming signal is in a digital format or, if not, is converted thereto. Next, the sound level on the incoming signal is estimated 104. As discussed in different embodiments below, the sound level can be estimated in a variety of different ways. Then, a decision 106 determines whether the estimated sound level indicates presence of a "no-sound" condition. Here, the decision 106 evaluates whether the estimated sound level indicates that the hearing aid device is not picking up any significant environmental sound. When the decision 106 determines that the estimated sound level does not indicate presence of the "no-sound" condition, then the hearing aid device is set 108 to the normal mode. Alternatively, when the decision 106 determines that the estimated sound level does indicate presence of a "no-sound" condition, the hearing aid is set 110 to the sleep mode. Once the hearing aid device is set to the sleep mode, the electronic circuitry of the hearing aid device consumes substantially less power than it otherwise would if it remained in the normal mode. As a result, power consumption by the hearing aid device is reduced while in the sleep mode. Since hearing aid devices typically operate on battery charge, the reduction in power consumption is beneficial because battery life is substantially improved. Following the operations 108 and 110, the power management processing 100 is complete and ends. However, it should be recognized that the power management processing 100 can be performed continuously or periodically as desired.

Figure 2:
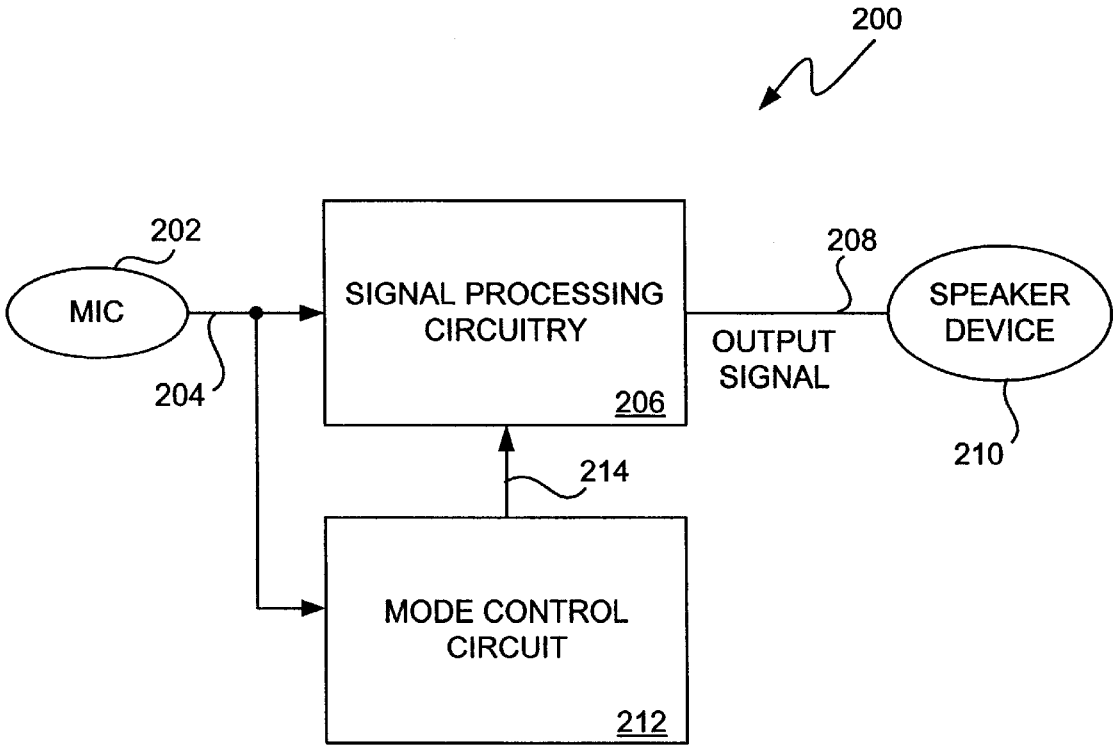
FIG. 2 is a block diagram of a power-managed hearing aid device according to one embodiment of the invention.

FIG. 2 is a block diagram of a power-managed hearing aid device 200 according to one embodiment of the invention. The power-managed hearing aid device 200 includes a microphone 202 that produces an incoming signal based on environmental sound picked up by the microphone 202. The incoming signal 204 is supplied to signal processing circuitry 206. The signal processing circuitry is, for example, embodied as an integrated circuit. The signal processing circuitry 206 performs various signal processing operations, namely, sound processing, and produces an output signal 208. Often, the sound processing utilized complicated sound processing algorithms to for high precision results. The output signal 208 is directed to a speaker device (also referred to as receiver) 210 so as to provide amplified sound to the user of the power-managed hearing aid device 200. The signal processing circuitry 206 produces the output signal 208 in accordance with various parameters that are utilized to provide the output signal 208 with particular characteristics such that the amplified sound produced by the speaker device 210 is beneficial in assisting the user in hearing the environmental sound.

The power-managed hearing aid device 200 further includes a mode control circuit 212. The mode control circuit 212 also receives the incoming signal 204 from the microphone 202. The mode control circuit 212 uses the incoming signal 204 to decide which of a plurality of different modes the power-managed hearing aid 200 device should operate in. The mode control circuit 212 produces a mode control signal 214 that is supplied to the signal processing circuitry 206 to implement the power management. For example, when the signal processing circuitry 206 has a normal mode and a reduced power mode, the mode control signal 214 can be used to cause the signal processing 206 to switch between these modes.

Figure 3:
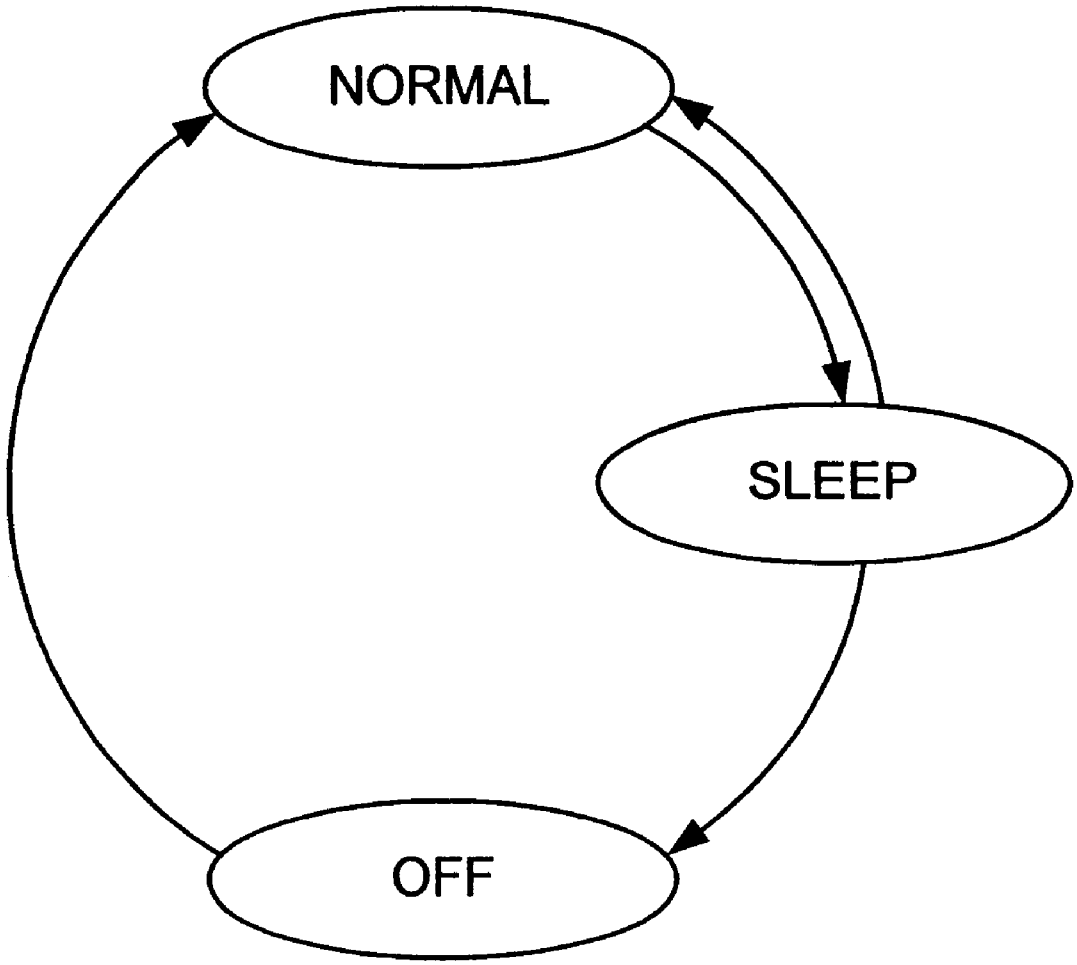
FIG. 3 indicates three modes of operation for signal processing circuitry of a power-managed hearing aid device according to one embodiment of the invention.

FIG. 3 indicates three modes of operation for signal processing circuitry of a power-managed hearing aid device according to one embodiment of the invention. For example, these three modes of operation can be supported by the signal processing circuitry 206 of the power-managed hearing aid device 200. As shown in FIG. 3, a mode control signal (e.g., the mode control signal 214) can cause the signal processing circuitry (e.g., the signal processing circuitry 206) to operate in a normal mode, a sleep mode, and an off mode. While in the normal mode, the signal processing circuitry operates in its typical operational mode such that its circuitry is fully enabled and thus consumes substantial amounts of power. In the sleep mode, the signal processing circuitry is only partially activated such that its power consumption is substantially reduced as compared with the normal mode. Still further, when the signal processing circuitry is placed in the off mode (i.e., power down mode), the signal processing circuitry effectively consumes no power.

Further, as shown in FIG. 3, the transitions between different modes can be specified or controlled. As shown in FIG. 3, the signal processing circuitry can transition from the normal mode to the sleep mode when the environmental sound indicates the "no-sound" condition. Then, from the sleep condition, the signal processing circuitry can further transition to the off mode when the hearing aid device remains in the sleep mode for a predetermined duration of time. Also, the signal processing circuitry can transition from the sleep mode back to the normal mode when the environmental sound no longer indicates the presence of the "no-sound" condition. The signal processing circuitry can likewise transition from the off mode to the normal mode upon detection of environmental sound. These various transitions can all be performed automatically under the control of a mode control circuit (e.g., the mode control circuit 212).

The hearing aid device can also include a manual means for transitioning between the various modes.

The mode control circuit preferably controls the switching between the various modes such that the user of the hearing aid device is not significantly impacted by such mode switching for power reduction. More particularly, the switching between normal mode and sleep mode can be performed in a graceful manner so that the user of the hearing aid device neither hears a noticeable glitch upon entering the sleep mode (going to sleep) nor misses a portion of useful sound when returning to the normal mode from the sleep mode (waking up).

Figure 4:
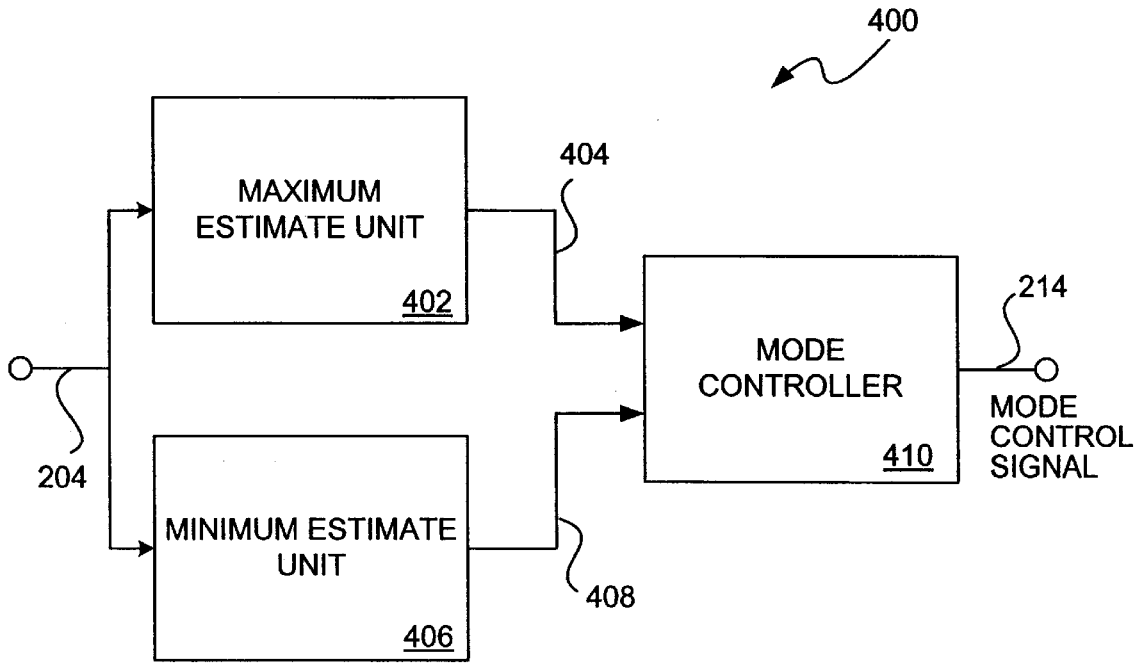
FIG. 4 is a block diagram of a mode control circuit according to one embodiment of the invention.

FIG. 4 is a block diagram of a mode control circuit 400 according to one embodiment of the invention. The mode control circuit 400 is, for example, suitable for use as the mode control circuit 212 illustrated in FIG. 2. The mode control circuit 400 includes a maximum estimate unit 402 that produces a maximum estimate for the incoming signal 204. The mode control circuit 400 also includes a minimum estimate unit 406 that obtains a minimum estimate signal 408 for the incoming signal 204. Still further, the mode control circuit 400 includes a mode controller 410. The mode controller 410 receives the maximum estimate signal 404 from the maximum estimate unit 402 and receives the minimum estimate signal 408 from the minimum estimate unit 406. The mode controller 410 produces the mode control signal 214 using the maximum estimate signal 404 and the minimum estimate signal 408. In other words, the mode control signal 214 that is produced by the mode controller 410 causes the operational mode of the hearing aid device to be controlled in accordance with one or both of the maximum estimate signal 404 and the minimum estimate signal 408.

Figure 5:
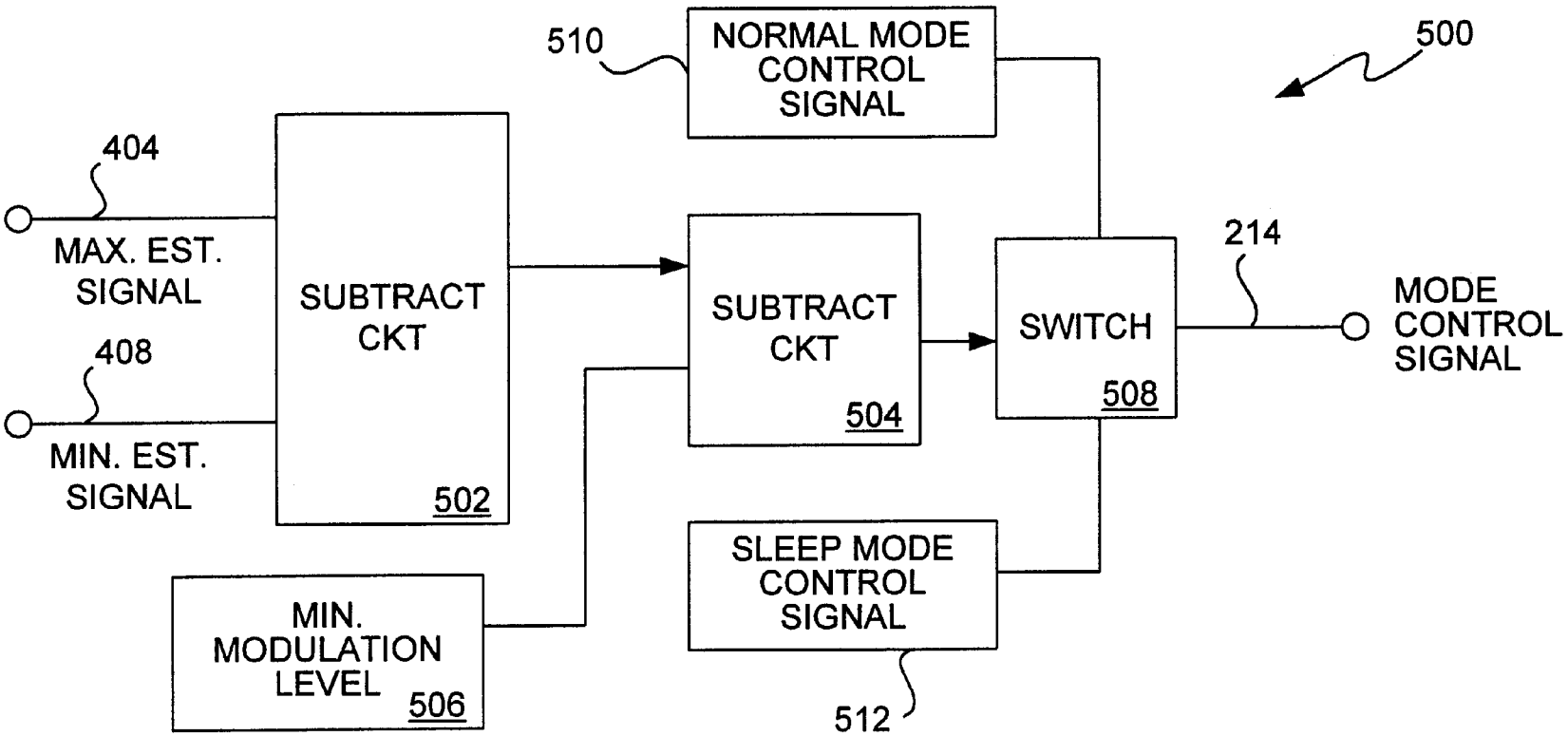
FIG. 5 is a block diagram of a mode controller according to one embodiment of the invention.
Figure 6:
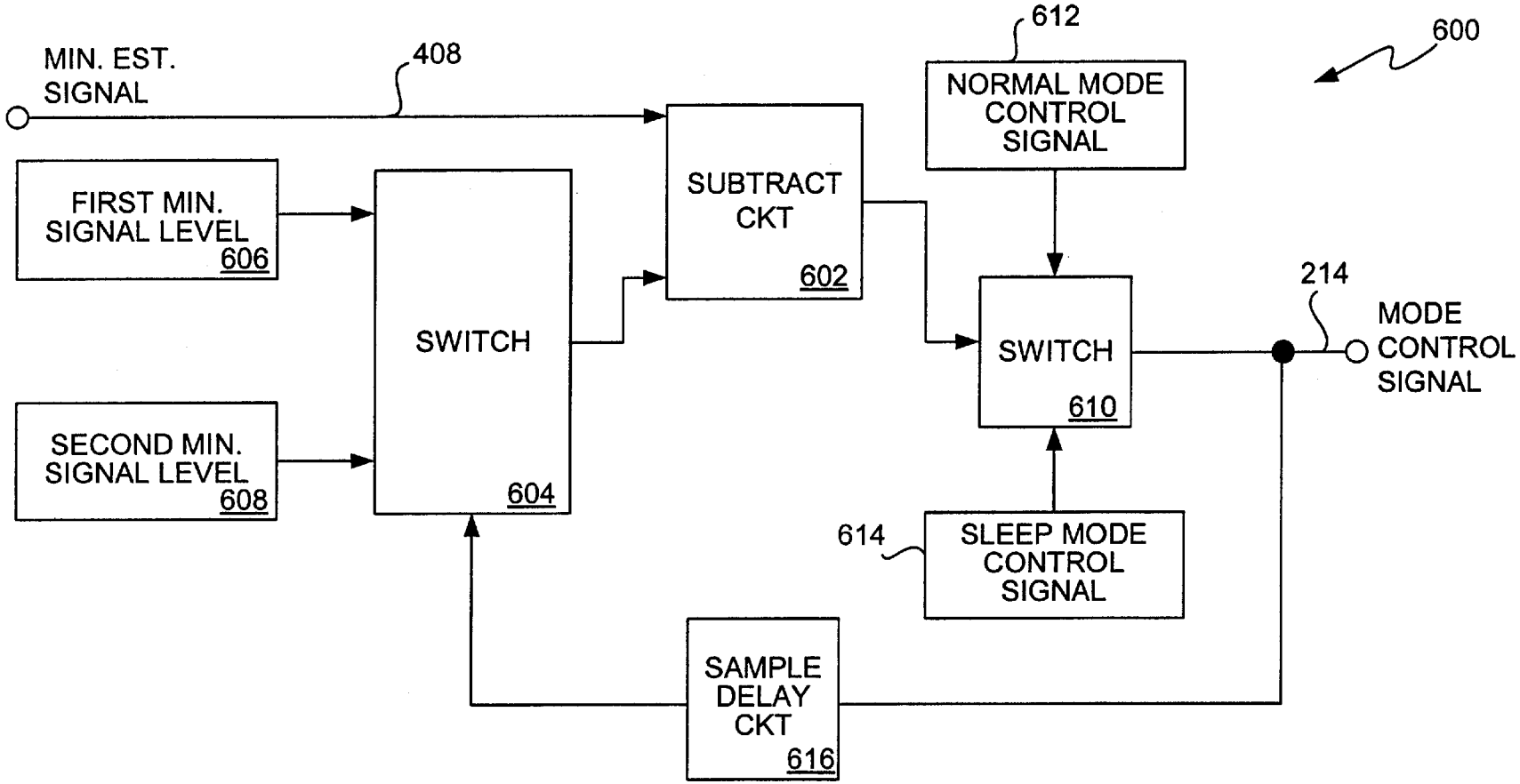
FIG. 6 is a block diagram of a mode controller according to another embodiment of the invention.
Figure 7:
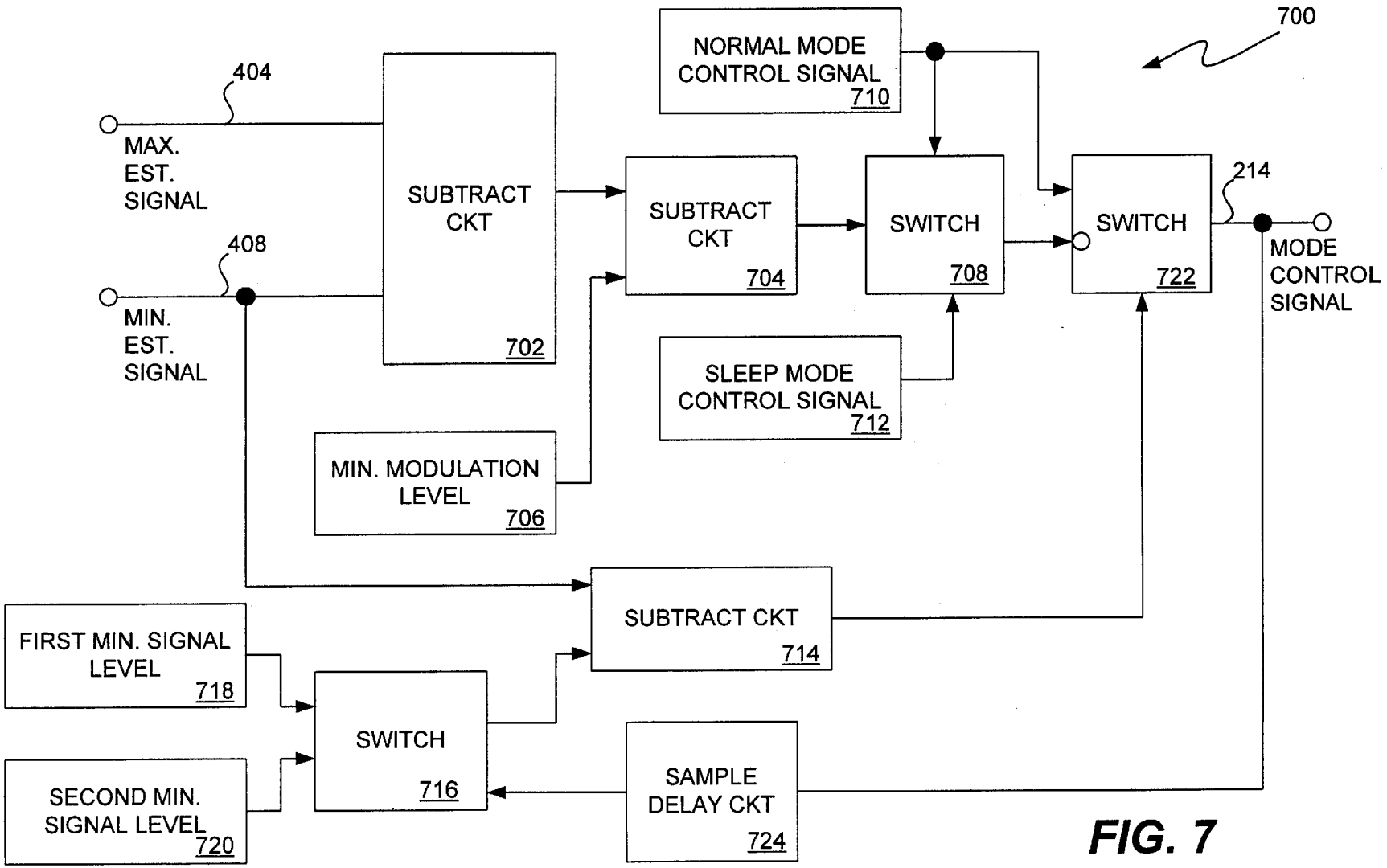
FIG. 7 is a block diagram of a mode controller according to still another embodiment of the invention.

In producing the mode control signal 214, the mode controller 410 can operate in a variety of different ways using one or both of the maximum estimate signal 404 and the minimum estimate signal 408. FIGS. 5–7 provide different embodiments suitable for use as the mode controller 410. Preferably, the switching between modes, as controlled by the mode control signal, is done in a graceful manner, such that substantial glitches do not occur upon transitioning from the normal mode to the sleep mode and that portions of useful sound are not dropped when transitioning from the sleep mode to the normal mode.

FIG. 5 is a block diagram of a mode controller 500 according to one embodiment of the invention. The mode controller 500 is, for example, suitable for use as the mode controller 410 illustrated in FIG. 4. The mode controller 500 includes a subtract circuit 502 that receives the maximum estimate signal 404 and the minimum estimate signal 408. The subtract circuit 502 produces a difference signal that represents a measure of the modulation of the microphone 202 response to the environmental sound. The difference signal produced by the subtract circuit 502 is then compared against a minimum modulation level 506 by a subtract circuit 504. The minimum modulation level 506 represents a predetermined constant. For example, the minimum modulation level 506 can be manufacturer set or user/distributor-configurable. In one example, the minimum modulation level can bet set at 0.3. The difference signal produced by the subtract circuit 504 controls a switch 508. When the difference signal indicates that the modulation level determined by the subtract circuit 502 is less than the minimum modulation level 506, the switch 508 is controlled to select a sleep mode control signal 512 so that the mode control signal requests that the signal processing circuitry (e.g., the signal processing circuitry 206) be placed in the sleep mode. On the other hand, when the modulation level is determined to be greater than or equal to the minimum modulation level 506, the switch 508 is controlled to select a normal mode control signal 510 such that the mode control signal requests the signal processing circuitry to enter the normal mode.

FIG. 6 is a block diagram of a mode controller 600 according to another embodiment of the invention. The mode controller 600 is, for example, suitable for use as the mode controller 410 illustrated in FIG. 4. However, it should be recognized that the maximum estimate unit 402 is not needed by the mode controller 410 when the mode controller 600 implements the mode controller 410. The mode controller 600 includes a subtract circuit 602 and a switch 604. The switch 604 outputs either a first minimum signal level 606 or a second minimum signal level 608 depending upon a delayed mode control signal. The minimum signal level selected by the switch 604 is then compared against the minimum estimate signal 408 to produce a difference signal. The difference signal is supplied to a switch 610. When the difference signal indicates that the minimum estimate signal 408 is less than the selected minimum signal level, then the switch 610 outputs a sleep mode control signal 614 as the mode control signal 214. Alternatively, when the minimum estimate signal 408 exceeds the selected minimum signal level, the switch 610 outputs a normal mode control signal 612 as the mode control signal 214. Further, the mode control signal 214 is fed back to a sample delay circuit 614 that delays the mode control signal by a sample delay and supplies the delayed mode control signal (e.g., previous mode control signal) to the switch 604 to select the first minimum signal level 606 or the second minimum signal level 608. When the delayed mode control signal indicates the normal mode, then the first minimum signal level 606 is selected by the switch 604. On the other hand, when the delayed mode control signal pertains to the sleep mode, then the switch 604 selects the second minimum signal level 608. The first minimum signal level 606 and the second minimum signal level 608 are predetermined constants, with the second minimum signal 608 level being greater that the first minimum signal level 606. For example, the first and second minimum signal level 606 and 608 can be manufacturer set or user/distributor-configurable. This processing scheme of the mode controller 600 makes the mode control signal to have a hysteresis characteristic.

FIG. 7 is a block diagram of a mode controller 700 according to still another embodiment of the invention. The mode controller 700 is, for example, suitable for use as the mode controller 410 illustrated in FIG. 4. More particularly, the mode controller 700 illustrated in FIG. 7 is a more robust embodiment as it includes the benefits of both embodiments of the mode controller shown in FIGS. 5 and 6.

The mode controller 700 includes a subtract circuit 702 that receives the maximum estimate signal 404 and the minimum estimate signal 408. The subtract circuit 702 produces a difference signal that represents a measure of the modulation of the microphone 202 response to the environmental sound. The difference signal produced by the subtract circuit 702 is then compared against a minimum modulation level 706 by a subtract circuit 704. The minimum modulation level 706 represents a predetermined constant. For example, the minimum modulation level 706 can be manufacturer set or user/distributor-configurable. The difference signal produced by the subtract circuit 704 controls a switch 708. When the difference signal indicates that the modulation level determined by the subtract circuit 702 is less than the minimum modulation level 706, the switch 708 is controlled to select a sleep mode control signal 712 so that the mode control signal requests that the signal processing circuitry (e.g., the signal processing circuitry 206) be placed in the sleep mode. On the other hand, when the modulation level is determined to be greater than or equal to the minimum modulation level 706, the switch 708 is controlled to select a normal mode control signal 710 such that the mode control signal requests the signal processing circuitry to enter the normal mode.

The mode controller 700 further includes a subtract circuit 714 and a switch 716. The switch 716 outputs either a first minimum signal level 718 or a second minimum signal level 720 depending upon a delayed mode control signal. The minimum signal level selected by the switch 716 is then compared against the minimum estimate signal 408 to produce a difference signal. The difference signal is supplied to a switch 722. When the difference signal from the subtract circuit 714 indicates that the minimum estimate signal 408 is less than the selected minimum signal level, then the switch 722 outputs, as the mode control signal 214, one of the normal mode control signal 710 and the sleep mode control signal as selected by the switch 708 in accordance with modulation levels. Alternatively, when the difference signal from the subtract circuit 714 indicates the minimum estimate signal 408 exceeds the selected minimum signal level, the switch 722 outputs the normal mode control signal 710 as the mode control signal 214. Further, the mode control signal 214 is fed back to a sample delay circuit 724 that delays the mode control signal by a sample delay and supplies the delayed mode control signal (e.g., previous mode control signal) to the switch 716 to select the first minimum signal level 718 or the second minimum signal level 720. When the delayed mode control signal indicates the normal mode, then the first minimum signal level 718 is selected by the switch 716. On the other hand, when the delayed mode control signal pertains to the sleep mode, then the switch 716 selects the second minimum signal level 720. The first minimum signal level 718 and the second minimum signal level 720 are predetermined constants, with the second minimum signal level 720 being greater that the first minimum signal level 718. For example, the first and second minimum signal level 718 and 720 can be manufacturer set or user/distributor-configurable.

Figure 8:
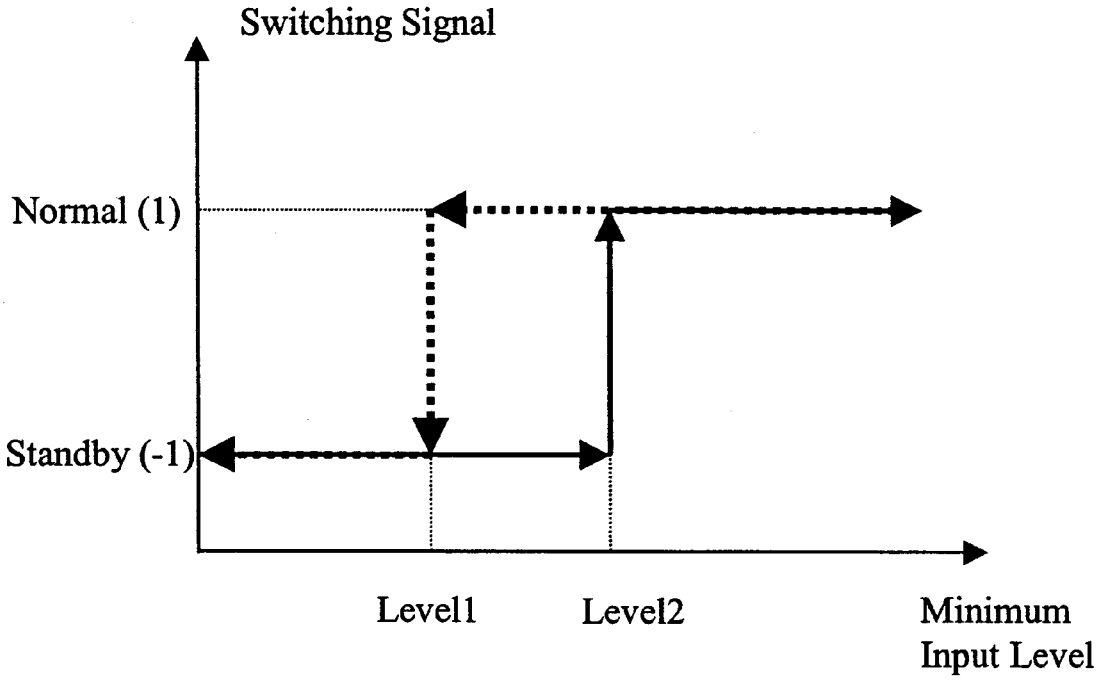
FIG. 8 is a graphical representation of the mode control signal transitions as provided by the embodiments of the mode controller shown in FIGS. 6 and 7.

FIG. 8 is a graphical representation of the mode control signal transitions as provided by the embodiments of the mode controller shown in FIGS. 6 and 7. As shown in FIG. 8, transitions between normal mode and sleep (standby) mode are performed using two different minimum input levels for the incoming sound signal. For example, transition from the sleep mode to the normal mode uses the larger minimum level, whereas transition from the normal mode to the sleep mode uses the smaller minimum level. These different minimum levels thus provide hysteresis in the mode switching. The hysteresis yields smooth transitions between the modes.

Figure 9:
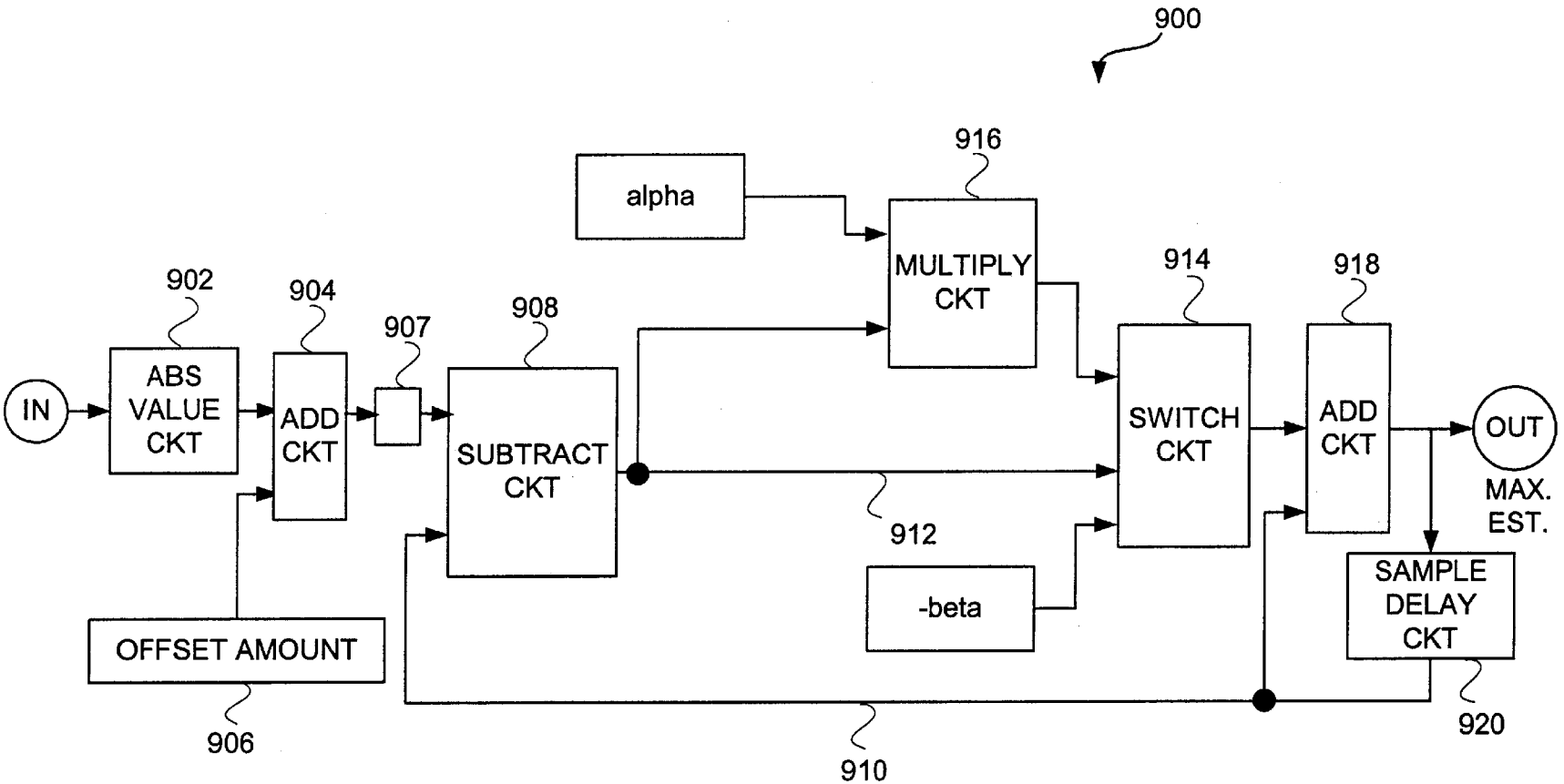
FIG. 9 is a block diagram of a maximum estimate unit according to one embodiment of the invention.

FIG. 9 is a block diagram of a maximum estimate unit 900 according to one embodiment of the invention. The maximum estimate unit 900 is, for example, suitable for use as the maximum estimate unit 402 discussed above with respect to FIG. 4. The maximum estimate unit 900 receives an input signal (e.g., electronic sound signal) that is to have its minimum estimated. The input signal is supplied to an absolute value circuit 902 that determines the absolute value of the input signal. An add circuit 904 adds the absolute value of the input signal together with an offset amount 906 and thus produces an offset absolute value signal. The addition of the offset amount, which is typically a small positive value, such as 0.000000000001, is used to avoid overflow in division or logarithm calculations performed in subsequent circuitry. The offset absolute value signal from the add circuit 904 is first converted to a logarithm value by a logarithm circuit 907 and then supplied to a subtract circuit 1008. The subtract circuit 908 subtracts a previous output 910 from the offset absolute value signal to produce a difference signal 912. The difference signal 912 is supplied to a switch circuit 914 and a multiply circuit 916. The multiply circuit 916 multiplies the difference signal 912 by a first constant (alpha). The switch circuit 914 selects one of a second constant (−beta) or the output of the multiply circuit 916 based on the difference signal 912. The output of the switch circuit 914 represents an adjustment amount. The adjustment amount is supplied to an add circuit 918. The add circuit 918 adds the adjustment amount to the previous output 910 to produce a maximum estimate for the input signal. A sample delay circuit 920 delays the maximum estimate by a delay (1/z) to yield the previous output 910 (where 1/z represents a delay operation). For example, in one implementation, alpha can be 0.05 and −beta can be −0.001.

Figure 10:
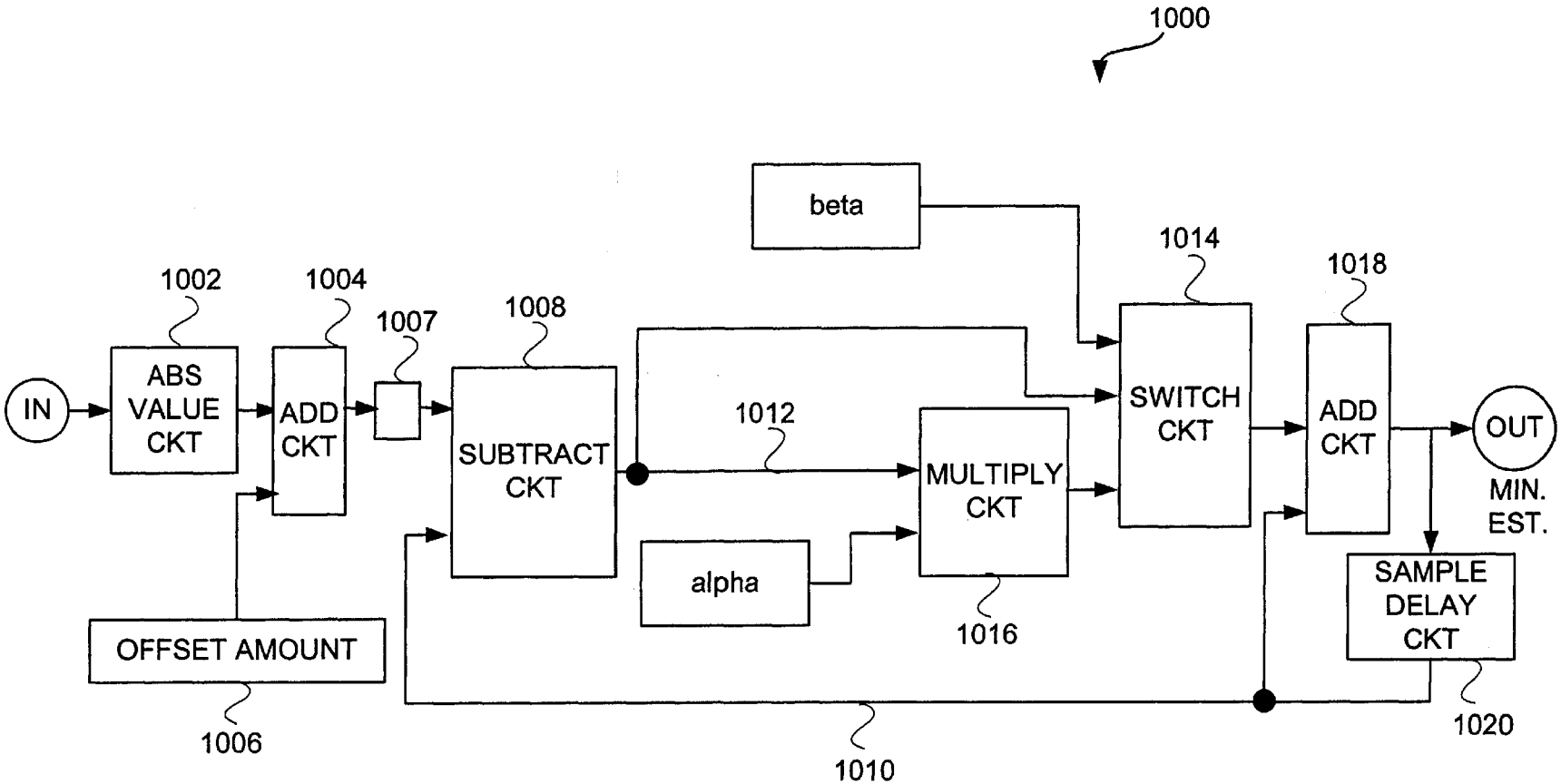
FIG. 10 is a block diagram of a minimum estimate unit according to another embodiment of the invention.

FIG. 10 is a block diagram of a minimum estimate unit 1000 according to one embodiment of the invention. The minimum estimate unit 1000 is, for example, suitable for use as the minimum estimate unit 406 discussed above with respect to FIG. 4. The minimum estimate unit 1000 receives an input signal (e.g., electronic sound signal) that is to have its minimum estimated. The input signal is supplied to an absolute value circuit 1002 that determines the absolute value of the input signal. An add circuit 1004 adds the absolute value of the input signal together with an offset amount 1006 and thus produces an offset absolute value signal. The addition of the offset amount, which is typically a small positive value, such as 0.000000000001, is used to avoid overflow in division or logarithm calculations performed in subsequent circuitry. The offset absolute value signal from the add circuit 1004 is first converted to a logarithm value by a logarithm circuit 1007 and then supplied to a subtract circuit 1008. The subtract circuit 1008 subtracts a previous output 1010 from the offset absolute value signal to produce a difference signal 1012. The difference signal 1012 is supplied to a switch circuit 1014 and a multiply circuit 1016. The multiply circuit 1016 multiplies the difference signal 1012 by a first constant (alpha). The switch circuit 1014 selects one of a second constant (beta) or the output of the multiply circuit 1016 based on the difference signal 1012. The output of the switch circuit 1014 represents an adjustment amount. The adjustment amount is supplied to an add circuit 1018. The add circuit 1018 adds the adjustment amount to the previous output 1010 to produce a maximum estimate for the input signal. A sample delay circuit 1020 delays the minimum estimate by a delay (1/z) to yield the previous output 1010 (where 1/z represents a delay operation). For example, in one implementation, alpha can be 0.05 and beta can be 0.001.

The invention is preferably implemented in hardware, but can be implemented in software or a combination of hardware and software. The invention can also be embodied as computer readable code on a computer readable medium. The computer readable medium is any data storage device that can store data which can be thereafter be read by a computer system. Examples of the computer readable medium include read-only memory, random-access memory, CD-ROMs, magnetic tape, optical data storage devices, carrier waves. The computer readable medium can also be distributed over a network coupled computer systems so that the computer readable code is stored and executed in a distributed fashion.

The advantages of the invention are numerous. Different embodiments or implementations may yield one or more of the following advantages. One advantage of the invention is that power consumption for hearing aids is able to be managed to prolong battery life. Another advantage of the invention is that transitions between normal and power saving modes can be done in a manner that is perceptively smooth to the user.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. A method for managing power consumption of a hearing aid device, said method comprising:

obtaining a sound identification for a sound signal picked-up by the hearing aid device, said obtaining including at least estimating a minimum level for the sound signal and a modulation measurement and using the minimum level and the modulation measurement to obtain the sound identification for the sound signal;

determining whether sound to be processed is present based on the sound identification for the sound signal; and placing the hearing aid device in a reduced power mode when the said determining determines that no significant sound to be processed is present.

2. A method as recited in claim 1, wherein the reduced power mode is a sleep mode.

3. A method as recited in claim 1, wherein said method further comprises:

returning the hearing aid device to a normal power mode when said determining determines that significant sound to be processed is present.

4. A method as recited in claim 1, wherein said obtaining comprises:

estimating the minimum level for the sound signal;

selecting one of a plurality of reference minimum signal levels;

comparing the minimum level with the selected reference minimum signal level to produce a comparison signal; and obtaining the sound identification for the sound signal based on the comparison signal.

5. A method as recited in claim 1, wherein said obtaining comprises:

estimating a maximum level for the sound signal;

estimating the minimum level for the sound signal; and obtaining the sound identification for the sound signal based on the maximum level and the minimum level for the sound signal.

6. A method as recited in claim 1, wherein said obtaining comprises:

estimating a maximum level for the sound signal;

estimating the minimum level for the sound signal;

determining a difference signal between the maximum level and the minimum level; and obtaining the sound identification for the sound signal based on the difference signal.

7. A method as recited in claim 1, wherein said obtaining comprises:

estimating a maximum level for the sound signal;

estimating the minimum level for the sound signal;

determining a difference signal between the maximum level and the minimum level;

comparing the minimum level with a predetermined minimum signal level to produce a comparison signal; and obtaining the sound identification for the sound signal based on the difference signal and the comparison signal.

8. A method as recited in claim 1, wherein said obtaining comprises:

estimating a maximum level for the sound signal;

estimating the minimum level for the sound signal;

determining a difference signal between the maximum level and the minimum level;

selecting one of a plurality of reference minimum signal levels;

comparing the minimum level with the selected reference minimum signal level to produce a comparison signal; and obtaining the sound identification for the sound signal based on the difference signal and the comparison signal.

9. A method as recited in claim 8, wherein said determining of whether sound to be processed is present produces a mode control signal, and wherein said selecting of one of the plurality of reference minimum signal levels is performed using a previous mode control signal.

10. A method for managing power consumption of a hearing aid device, said method comprising:

monitoring at least one signal characteristic for a sound signal picked-up by the hearing aid device; and switching between a normal power mode and a reduced power mode for the hearing aid device in accordance with the at least one signal characteristic for the sound signal, wherein said switching is based on at least a modulation measurement and a minimum signal level for the sound signal picked-up by the hearing aid device.

11. A method as recited in claim 10, wherein said switching is performed with hysteresis.

12. A hearing aid device, comprising:

a microphone for picking up a sound signal;

signal processing circuitry operatively connected to said microphone, said signal processing circuitry operating to process the sound signal to produce a modified sound signal, said signal processing circuitry operating in a normal mode and a reduced power mode;

a mode control circuit operatively connected to said signal processing circuitry, said mode control circuit controlling whether said signal processing circuitry operates in the normal mode or the reduced power mode; and an output device that produces an output sound in accordance with the modified sound signal, wherein said mode control circuit controls switching between the normal mode and the reduced power mode for said signal processing circuitry based on at least a modulation measurement and a minimum signal level for the sound signal.

13. A hearing aid device as recited in claim 12, wherein said mode control circuit controls switching between the normal mode and the reduced power mode for said signal processing circuitry based on at least one signal characteristic of the sound signal.

14. A hearing aid device as recited in claim 13, wherein said mode control circuit controls switching between the normal mode and the reduced power mode such that such switching is performed with hysteresis.

* * * * *